US010533291B2

(12) United States Patent
Perkins

(10) Patent No.: US 10,533,291 B2
(45) Date of Patent: Jan. 14, 2020

(54) SNOW MELTING MAT

(71) Applicant: Craig A. Perkins, Lynn Haven, FL (US)

(72) Inventor: Craig A. Perkins, Lynn Haven, FL (US)

( * ) Notice: Subject to any disclaimer, the term of this patent is extended or adjusted under 35 U.S.C. 154(b) by 162 days.

(21) Appl. No.: 14/596,095

(22) Filed: Jan. 13, 2015

(65) Prior Publication Data

US 2016/0201272 A1 Jul. 14, 2016

(51) Int. Cl.
*H05B 3/68* (2006.01)
*E01C 11/24* (2006.01)
*E01H 5/10* (2006.01)

(52) U.S. Cl.
CPC ..... *E01C 11/245* (2013.01); *E01H 5/10* (2013.01)

(58) Field of Classification Search
CPC . E01H 5/10; F28F 3/12; F28F 2210/00; F28F 9/02; E01C 11/245; F24J 2/00; F24J 2/24; F24J 2/245
USPC .... 219/449.1, 528, 535, 548, 211, 549, 546, 219/441, 441.1; 126/583, 591, 598; 428/209, 408
See application file for complete search history.

(56) References Cited

U.S. PATENT DOCUMENTS 3,640,552 A * 2/1972 Demler, Sr. ..... F16L 37/084 285/110
4,646,818 A * 3/1987 Ervin, Jr. ..... E01C 11/26 165/45
4,664,818 A * 5/1987 Halliday ..... C09K 8/24 507/113
4,880,051 A 11/1989 Ohashi
5,357,724 A * 10/1994 Sonoda ..... E04F 11/16 52/177
5,431,149 A * 7/1995 Fossum ..... F24J 2/265 126/659

(Continued)

FOREIGN PATENT DOCUMENTS

JP 6-108430 4/1994
JP 8-269908 10/1996

(Continued)

OTHER PUBLICATIONS

Heated Stair and Walkway Mats, Heattrack® website: http://www.heattrak.com/Products/Residential-Products.htm.

*Primary Examiner* — Phuong Nguyen
*Assistant Examiner* — Chris Liu
(74) *Attorney, Agent, or Firm* — Richard C. Litman; Nath, Goldberg & Meyer

(57) ABSTRACT

The snow melting mat includes an elongate, substantially flat sheet of a desired length connected to a recirculation header at one end and a circulation header at the opposite end. The sheet includes a plurality of channels defined inside the sheet. The channels permit heated liquid to circulate along the length of the sheet. A heater-pump heats the liquid that maintains the temperature of the sheet at several degrees above freezing and pumps the liquid through the recirculation header, the sheet, and the circulation header. A plurality of transverse grooves is formed on the top of the sheet to provide a gripping, walking surface. The grooves taper in depth to permit melted snow and ice to run off the sides of the sheet. Couplers and joints permit multiple sheets to be joined together in any desired pattern.

12 Claims, 8 Drawing Sheets

(56) References Cited

U.S. PATENT DOCUMENTS

| | | | | |
|---|---|---|---|---|
| 5,854,470 | A * | 12/1998 | Silva | E01C 11/265 219/528 |
| 5,957,378 | A * | 9/1999 | Fiedrich | F24D 3/14 165/45 |
| 5,964,402 | A | 10/1999 | Jakobson | |
| 5,966,502 | A | 10/1999 | Pearce | |
| 6,180,929 | B1 | 1/2001 | Pearce | |
| 6,325,297 | B1 | 12/2001 | Calvin et al. | |
| 6,909,074 | B1 | 6/2005 | Bradley | |
| 6,987,928 | B2 | 1/2006 | Shields | |
| 7,013,609 | B2 * | 3/2006 | Hydock | F24D 3/142 165/49 |
| 7,628,150 | B2 | 12/2009 | Malkov | |
| 7,905,645 | B2 * | 3/2011 | Batti | A47G 27/0243 362/234 |
| 8,076,619 | B1 * | 12/2011 | Wingale | A47G 27/0287 182/178.1 |
| 8,336,146 | B1 * | 12/2012 | Berbash | H05B 3/34 14/69.5 |
| 2006/0272631 | A1 | 12/2006 | Coke et al. | |
| 2008/0092587 | A1 * | 4/2008 | Gorbounov | F25B 39/028 62/498 |
| 2008/0251245 | A1 * | 10/2008 | Gorbounov | F25B 39/028 165/178 |

FOREIGN PATENT DOCUMENTS

| | | |
|---|---|---|
| JP | 10-176302 | 6/1998 |
| JP | 2000-328509 | 11/2000 |
| JP | 2002-88730 | 3/2002 |
| JP | 2010059649 A * | 3/2010 |

* cited by examiner

SNOW MELTING MAT

BACKGROUND OF THE INVENTION

1. Field of the Invention

The present invention relates to cold weather safety devices, and particularly to a snow melting mat providing a safe walking surface.

2. Description of the Related Art

One of the most dangerous consequences in a snow-laden area is slippery surfaces where the general population must walk. Any accidental slips on the surface can potentially lead to severe physical harm. In addition, persons confined to wheelchairs or who require the assistance of walkers, crutches, or canes generally require a surface that has been cleared of snow and ice. In most instances, this potential hazard can be minimized by salting the desired areas, such as sidewalks, walkways, porches and driveways, prior to a snow or ice storm, followed by plowing the snow and ice as it accumulates. However, salt can be relatively expensive, depending on the size of the desired area to be covered. Plowing or shoveling of the ice and snow requires great physical expenditure, which may be a daunting or even impossible task for the elderly or infirm. Of course mechanical plows or plow tractors may be used to make this task easier, but most homeowners may not have the necessary financial resources for such a convenience.

Thus, a snow melting mat solving the aforementioned problems is desired.

SUMMARY OF THE INVENTION

The snow melting mat includes an elongate, substantially flat sheet forming a mat of a desired length, the mat being connected to a recirculation header at one end and a circulation header at the opposite end. The mat or sheet includes a plurality of channels defined inside the mat. These channels permit heated liquid to circulate along the length of the mat. A heater-pump heats the liquid that maintains the temperature of the mat sheet at several degrees above freezing and pumps the liquid through the recirculation header, the elongated sheet and the circulation header. A plurality of transverse grooves is formed on the top of the sheet to provide a gripping, walking surface. The grooves include curved surfaces for melted snow and ice to run off. The sheet is flexible and may include at least one strip of bendable material embedded therein so that the snow melting mat may conform to and maintain the contours of the surface on which the mat is laid. Attachments are provided to facilitate the desired layout of the snow melting mat.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
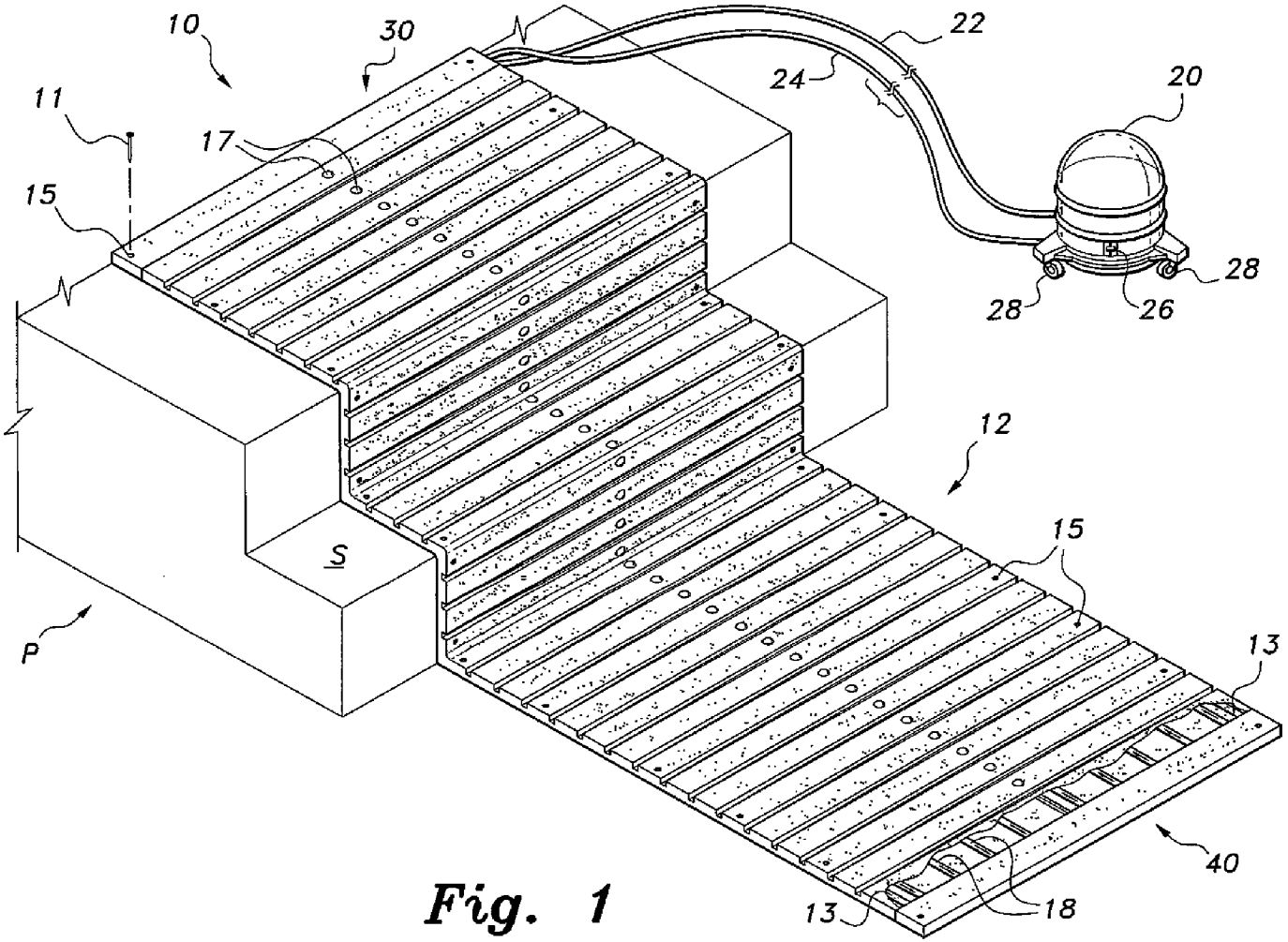
FIG. 1 is an environmental, perspective view of a snow melting mat according to the present invention, shown partially broken away at the circulation header to show details thereof.

The snow melting mat, generally referred to in the drawings by reference number 10, is configured to provide a safe walking surface or path for the user with minimal drain on the user's energy resources, especially in light of the relatively high heating costs associated with the wintry months or climates. Moreover, the snow melting mat 10 includes features permitting the snow melting mat 10 to be laid out into any layout design desired by the user.

Figure 2:
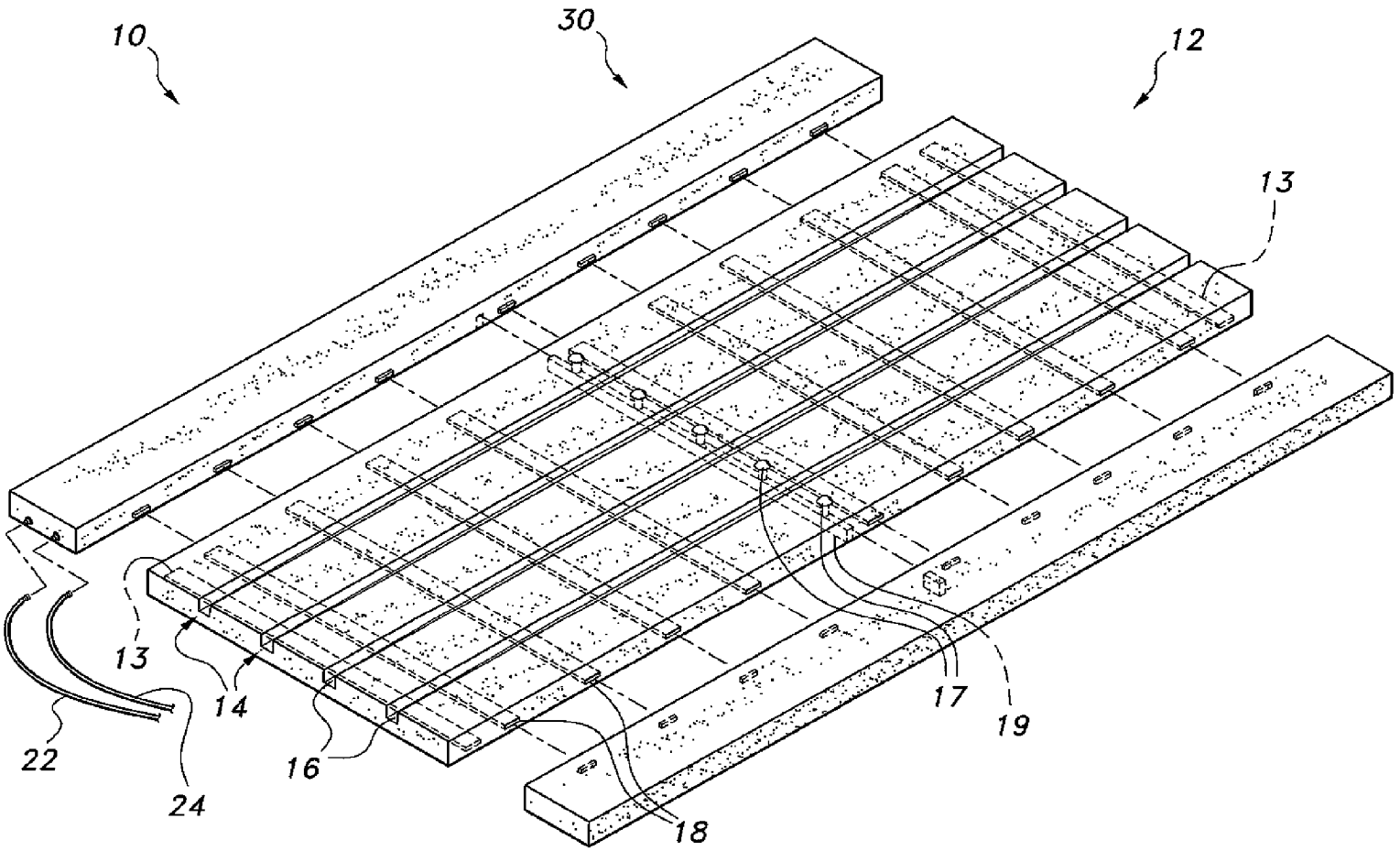
FIG. 2 is a partially exploded perspective view of a snow melting mat according to the present invention.

As shown in FIGS. 1 and 2, the snow melting mat 10 includes an elongate, substantially flat sheet or belt 12 connected to a recirculation header or first terminator attachment 30 at one end and a circulation header or second terminator attachment 40 at the opposite end. A heater-pump 20 is operatively attached to the recirculation header 30 and pumps heated liquid medium to the recirculation header 30. The heated medium flows from the recirculation header 30 through the sheet 12, heating the sheet 12 to a temperature at least several degrees above freezing, the temperature being sufficient to melt any accumulated snow and ice on the snow melting mat 10. A preferred temperature range is about 32-37° F. The circulation header 40 directs the flow from one side or half of the sheet 12 back through the other side or half of the sheet 12 towards the recirculation header 30, where the heater-pump 20 reheats the returned medium and continues to pump the medium through the recirculation header 30. More specific details of the components that facilitate this process follow.

The sheet or belt 12 is preferably supplied as a rolled or coiled sheet 12 that can be cut to the desired length. Alternatively, the sheet 12 may be provided in predetermined lengths. The top surface of the sheet 12 includes a plurality of spaced, transverse grooves 14 formed on or cut into the top surface. Theses grooves 14 form a tread pattern, which provides enhanced grip for those walking thereon. Although the drawings show straight grooves 14, the grooves 14 may be formed into a variety of tread patterns and configurations, including raised projections. Each groove 14 is about ¼" wide, and the floor 16 of the groove slopes downward from the longitudinal center line of the sheet 12 to the lateral edges of the sheet 12, providing a gradient or taper in the depth of the groove 14 that permits the melting snow to run off the sides of the sheet 12, thereby helping to keep the snow melting mat 10 free of snow and ice. Once laid, the sheet 12 may be anchored to the ground or walkway by anchoring pegs, nails, or other fasteners 11 through corresponding anchoring holes 15 formed in the sheet 12. As an alternative, the back side of the sheet 12 may include a friction-enhanced surface or projections that help prevent unwanted sliding of the snow melting mat 10.

The interior of the sheet 12 includes a plurality of parallel, spaced flow channels or veins 18 running the length of the mat sheet 12 between the recirculation header 30 and the circulation header 40. In the exemplary embodiment shown in FIGS. 1 and 2, the sheet 12 includes eight flow channels 18 divided into two sets of four, each set for directing the flow of medium in a certain direction. In this manner, one set of flow channels 18 is dedicated to facilitating fluid flow in one direction, while the other set of flow channels 18 is dedicated to fluid flow in the opposite direction. Of course any number of flow channels 18 or groupings thereof may be made in the mat sheet 12, so long as they permit medium to flow. These flow channels 18 may be molded into the sheet 12 or made from tubes embedded in the sheet 12. The material from which the sheet 12 is made and the material from which the flow channels 18 are made permit efficient heat transfer between the heated liquid medium and the top surface of the sheet 12 to melt snow and ice on the top surface. The flow channels 18 may be made from an elastomeric or resilient material to form a watertight friction fit with the nozzles of the headers 30, 40.

As shown in FIGS. 1-3 and 5, the snow melting mat 10 is heated by a circulating heated liquid medium pumped through the sheet 12 by a heater-pump 20. The preferred liquid medium is environmentally safe, biodegradable antifreeze that exhibits efficient heat transfer characteristics and has a much lower freezing point than water. This prevents any freezing of the liquid inside the sheet 12 when left outside in the cold for any length of time. In the preferred embodiment, the heater-pump 20 includes a first or outflow line 22 and a second or inflow line 24. The outflow line 22 directs the heated liquid medium from the pump 20 to the recirculation header 30 and consequently through the sheet 12, and the inflow line 24 directs the returning liquid medium through the recirculation header 30 back to the heater-pump 20 for reheating and continued circulation. As an alternative, the first and second lines 22, 24 may be combined into a single line with valves or different chambers for directing the required flow of the medium. The heater-pump 20 includes a control 26 for setting and monitoring the temperature of the liquid. The control 26 can also include a switch for selective powering of the heater-pump 20. Sensors may be provided to increase the operative parameters of the control 26, such as to monitor overheating and remote control.

Figure 7:
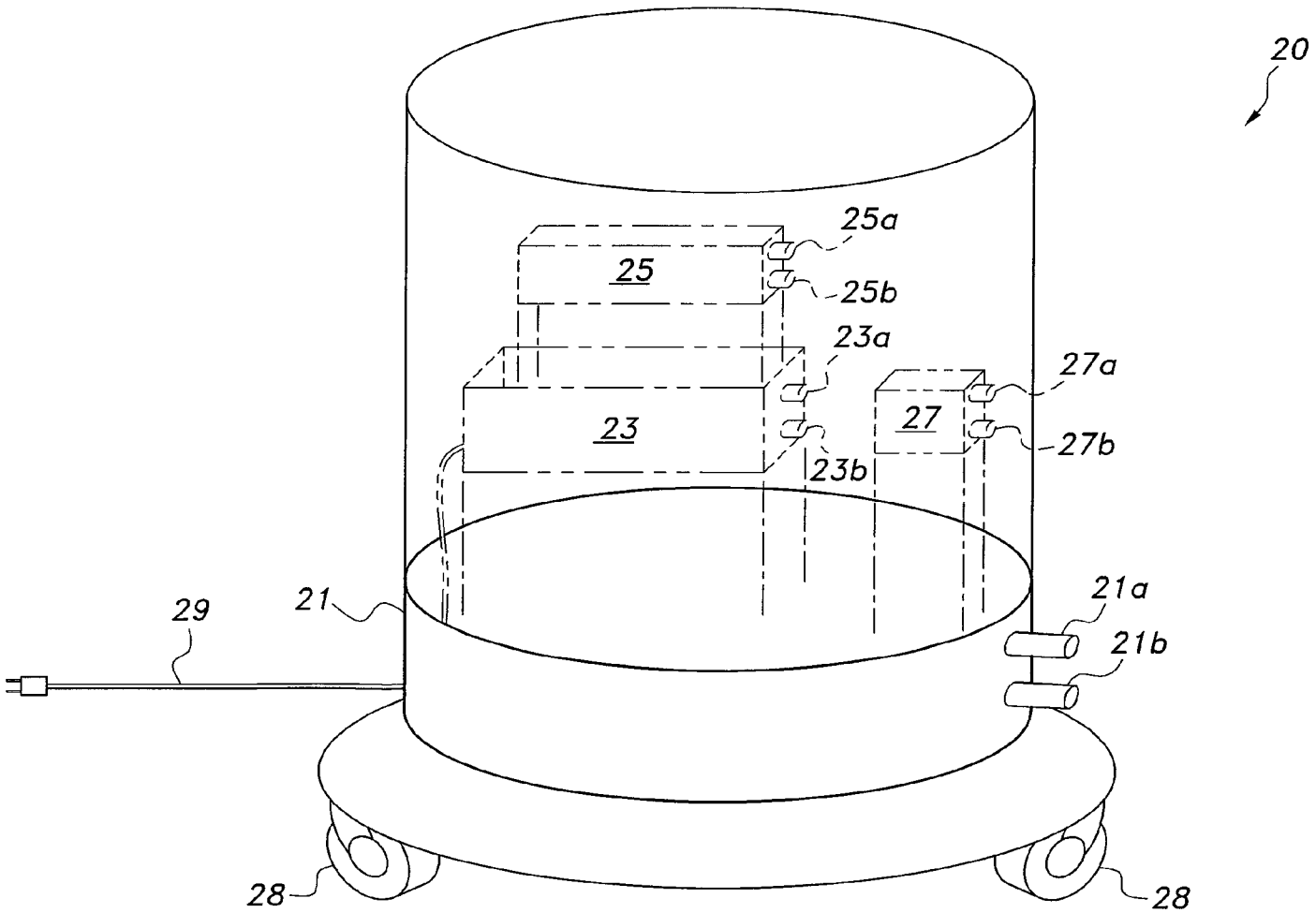
FIG. 7 is a diagrammatic perspective view of a heater-pump for a snow melting mat according to the present invention.

As best seen in FIGS. 1 and 7, the heater-pump 20 includes a housing 21 with couplings or connectors 21*a*, 21*b* communicating with the interior of the housing 21 for selective connection to the outflow line 22 and inflow line 24, respectively. The housing 21 stores the antifreeze to be heated and circulated through the snow melting mat 10. To increase portability and transport of the heater-pump 20, the housing 21 can be provided with a plurality of wheels or casters 28 to permit easy placement and/or storage of the heater-pump 20.

A heating unit 23 inside the housing 21 provides controlled heating of the antifreeze by a heater 25 contained within the heating unit 23. The heating unit 23 is coupled to a pump 27 which facilitates positive flow of the liquid medium or antifreeze through the outflow line 22 and the inflow line 24. A pair of couplings or connectors 27*a*, 27*b* extends from the pump 27 for selective connection to the connectors 21*a*, 21*b* of the housing 20. The heating unit 23 and the heater 25 may also be provided with respective connectors 23a, 23b and connectors 25*a*, 25*b* to connect with the pump 27 and communicate with the streams from the inflow line 22 and the outflow line 24. A power cord 29 extends from the housing 21 to provide selective connection to a power outlet and provide power for the heater 25 and the pump 27.

Figure 3:
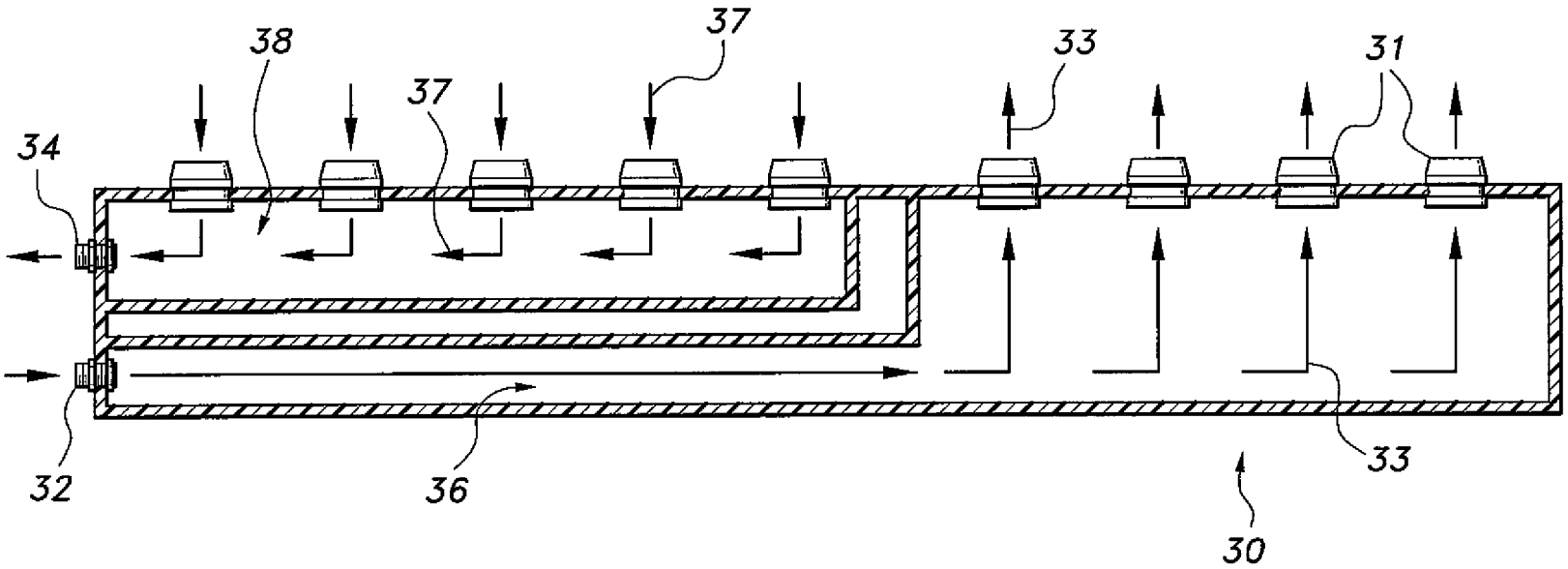
FIG. 3 is a top view in section of the recirculation header of a snow melting mat according to the present invention.

As shown in FIG. 3, the recirculation header 30 detachably mounted to one end of the sheet 12 may be a hollow, rectangular block divided into several chambers defining an inflow manifold 36 and an outflow manifold 38, the inflow manifold 36 for supply or inflow of the heated medium into the sheet 12, and the outflow manifold 38 for reception or outflow of the circulated medium from the sheet 12 to the pump 20. The first or inflow manifold 36 includes a first fluid connector 32 connected in a watertight seal with the outflow line 22. The inflow manifold 36 communicates with one set of attachment nozzles 31 engageable with a corresponding set of flow channels 18 on one side or half of the mat sheet 12. Thus, when the heater-pump 20 pumps the heated liquid medium into the first manifold 36, the liquid medium is directed towards the one side of the sheet 12 through the one set of attachment nozzles 31, as indicated by arrows 33. The second or outflow manifold 38 includes a second fluid connector 34 connected in a watertight seal with the inflow line 24. The outflow manifold 38 communicates with another set of attachment nozzles 31 engageable with a corresponding set of flow channels 18 on the other side or half of the mat sheet 12. Thus, as the liquid medium circulates through the other side of the mat sheet 18, the heater-pump 20 draws the circulated liquid medium through the outflow manifold 38, as indicated by arrows 37. As shown, the attachment nozzles 31 are preferably tapered to ease connection to the corresponding flow channels 18. Once mated, the connection should be watertight to prevent accidental overflow of the liquid medium during operation.

Figure 4A:
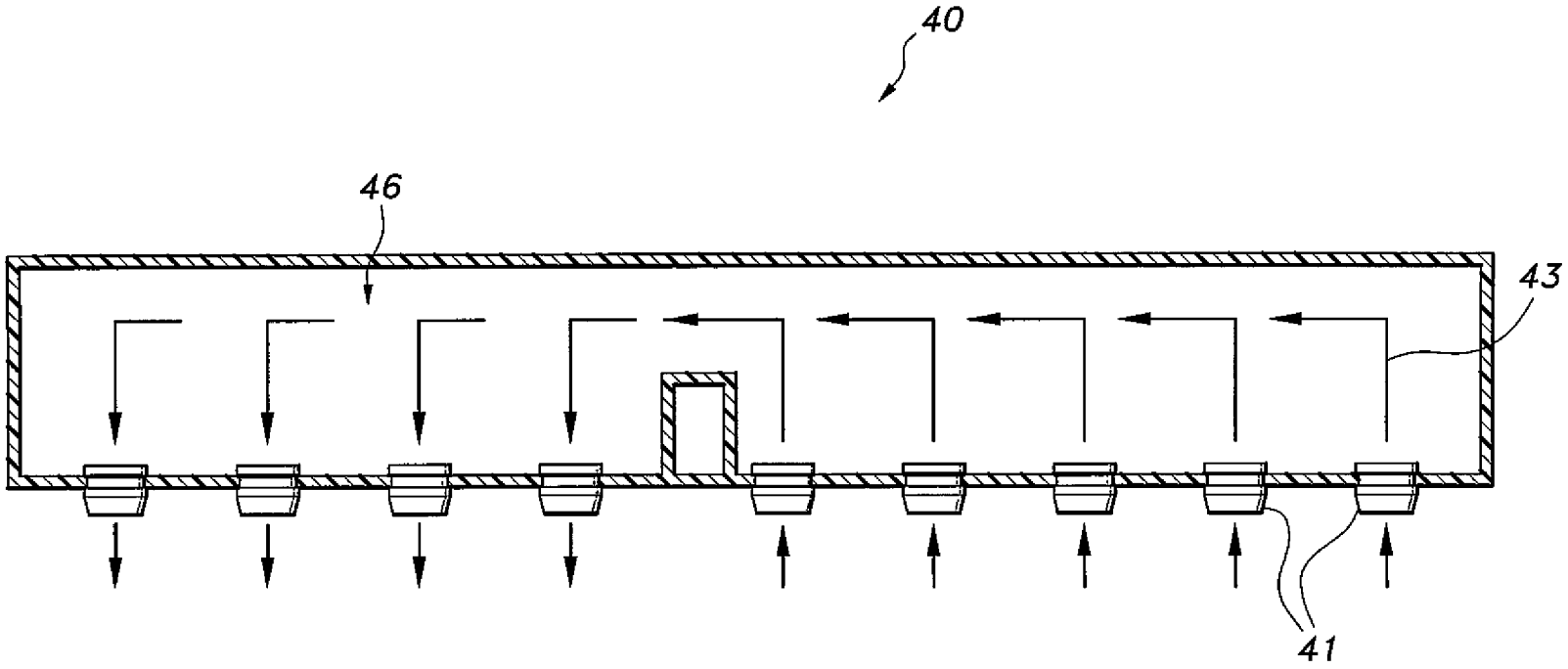
FIG. 4A is a top view in section of the circulation header of a snow melting mat according to the present invention.

The opposite end of the mat sheet 12 is capped by the circulation header 40. As shown in FIG. 4A, the circulation header 40 may be a hollow, rectangular block having a circulation manifold 46 therein. The circulation header 40 includes a plurality of attachment nozzles 41, similar to the attachment nozzles 31. The attachment nozzles 41 are connected to corresponding sets of flow channels 18 in the mat sheet 12. As the liquid medium flows into circulation manifold 46 from the one side or half of the mat sheet 12 through the corresponding set of nozzles 41, the back pressure from the incoming flow forces the liquid through the other set of nozzles 41 into the other side or half of the mat sheet 12, as indicated by arrows 43. Thus, the circulation header 40 facilitates circulation of the liquid through the snow melting mat 10.

Figure 4B:
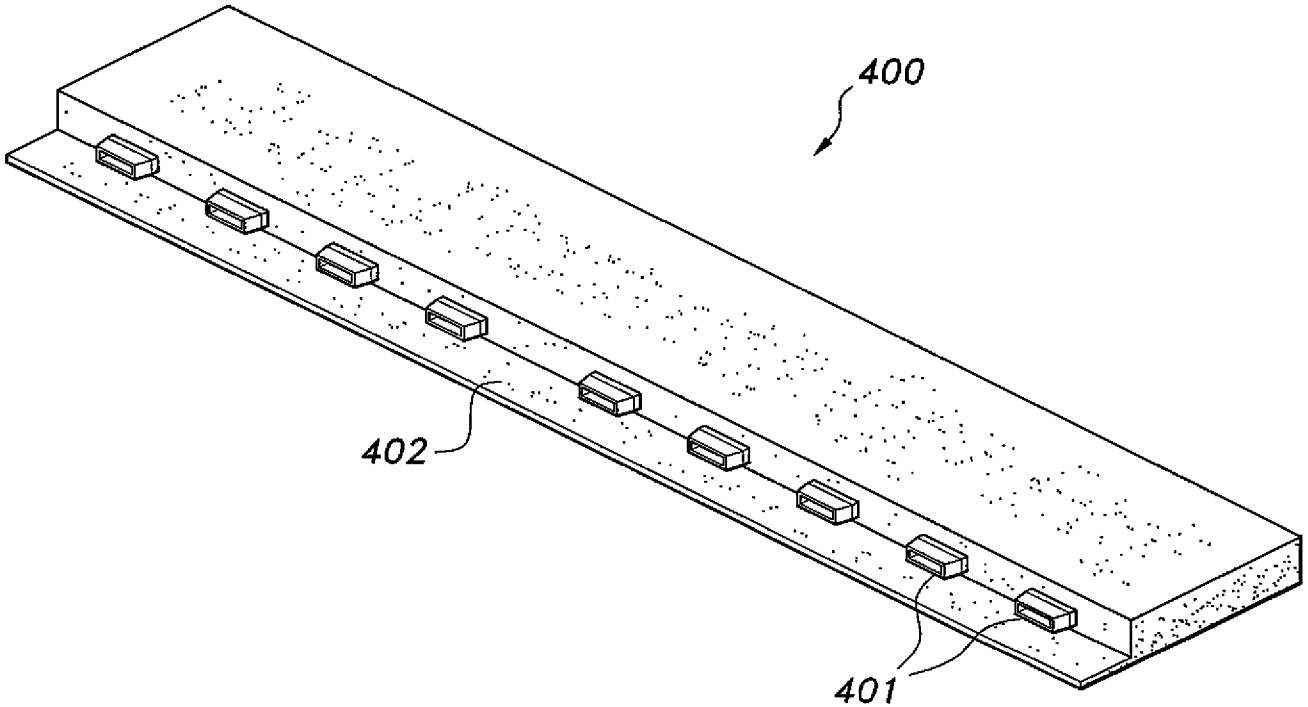
FIG. 4B is a perspective view of an alternative embodiment of a circulation header for a snow melting mat according to the present invention.

An alternative embodiment of a circulation header 400 is shown in FIG. 4B. The circulation header 400 is substantially the same construction as the circulation header 40, including tapered attachment nozzles 401. However, the circulation header 400 includes an outwardly extending flange or lip 402 projecting from the bottom of the circulation header 400. The lip 402 reinforces the structure of the circulation header 400, and also provides a guide strip for ease of installation onto the sheet 12. An additional lip 402 may be disposed on the top side. The recirculation header 30 may also include a similar lip and variations thereof for similar purposes.

Both the recirculation header 30 and the circulation header 40 or 400 are preferably made from durable plastic that is resistant to becoming brittle when exposed to cold or freezing temperatures. However, other materials such as metal, composites or combinations thereof, may also be used, so long as these materials exhibit similar durability and resistance.

The above form the basic components of the snow melting mat 10. For most applications of the snow melting mat 10, the snow melting mat 10 would be laid in a straight line path, e.g., the layout of a typical walkway or driveway. However, the snow melting mat 10 includes additional safety and configuration features that allow the snow melting mat 10 to be placed in a variety of desired paths or layout patterns.

One safety feature is disposed on the sheet 12. Night time, twilight, dusk, and inclement weather conditions tend to obfuscate a person's view in the absence of a visual aid. In order to help indicate and illuminate the safe areas to walk vis-à-vis the snow melting mat 10, the sheet 12 may include a plurality of LED (Light Emitting Diode) lights 17, as shown in FIGS. 1 and 2. These lights 17 may be flush with or project from the surface the sheet 12. Moreover, the lights 17 may be arranged in any desired pattern, such as the linear pattern shown in the drawings, or various geometric shapes. The wiring for the lights 17 may be housed in an LED bracket 19 disposed inside the sheet 12 or within a cavity defined in the sheet 12.

The sheet 12 is preferably made from vinyl, which exhibits good thermal conductivity and flexibility for conforming to the contours of a walkway, a driveway surface, or the ground. Other elastomeric materials with similar characteristics may also be used. The flexibility of the sheet 12 suits most ground surfaces, even those with abrupt contours. Moreover, the flexibility allows the user to roll up the snow melting mat 10 for easy storage when not in use. However, sharp angled surfaces, such as the corners on the steps S of a typical porch P, may create unseemly and potentially dangerous bulges on the snow melting mat 10 when the snow melting mat 10 is laid thereon. Therefore, the sheet 12 may include bendable contour strips 13 embedded in the sheet 12. The contour strips 13 are preferably made from pliable aluminum strips, which allow the user to bend the sheet 12 into any desired shape, e.g., the corner of a step S, and retain that shape. In addition, the aluminum is durable to withstand repeated use. Other metallic materials with similar characteristics may also be used to make the contour strips 13.

Figure 5:
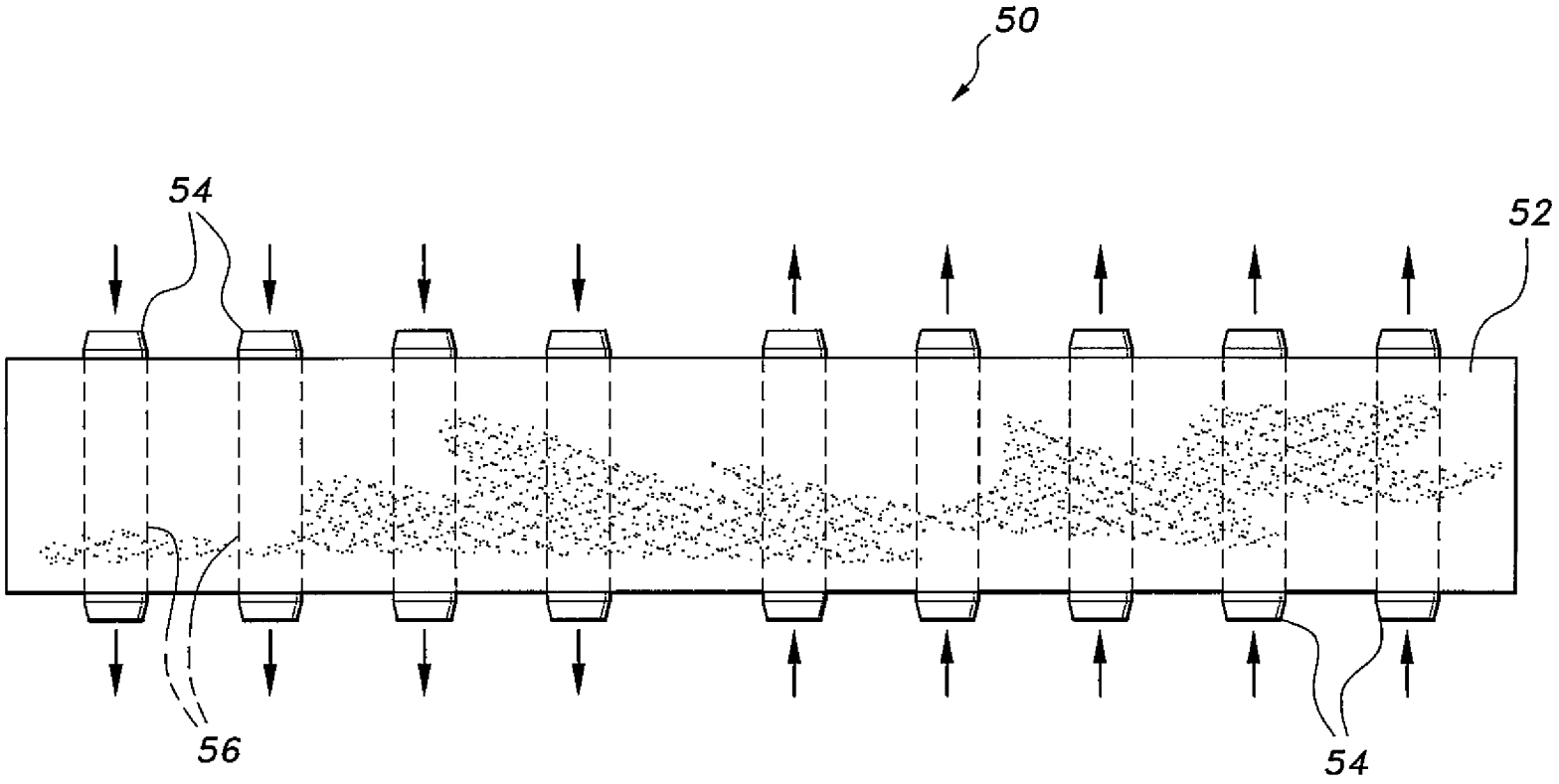
FIG. 5 is a top view of a splice attachment header for a snow melting mat according to the present invention.

Another feature that permits laying the snow melting mat 10 into a desired layout pattern is shown in FIG. 5. The splice coupler or attachment 50, shown in FIG. 5, is configured to permit the user to attach the ends of two separate lengths of the mat sheet 12. For example, if the walkway to be covered is ten feet long, the user may use the splice attachment 50 to connect two five foot lengths of the sheet 12. The splice attachment 50 may be a rectangular block 52 made from the same materials as the recirculation header 30 and the circulation header 40. A plurality of spaced attachment nozzles 54 is disposed on both sides of the block 52. Each nozzle 54 on one side is aligned with a corresponding nozzle 54 on the other side, and both communicate with each other through a bore 56. When the ends of separate sheets 12 are connected with the splice attachment 50, the bores 56 permit fluid flow between the separate mat sheets 12.

Figure 6:
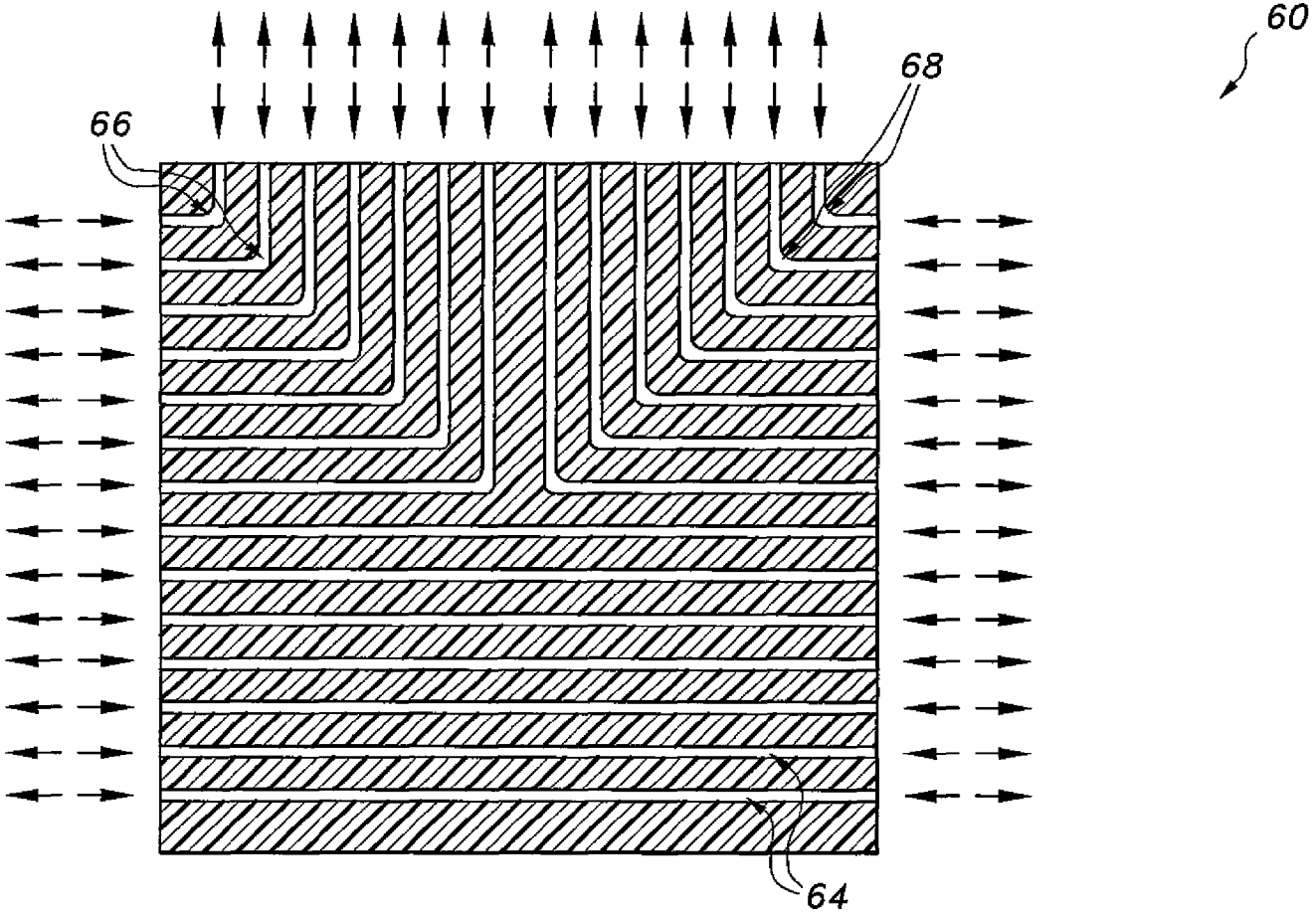
FIG. 6 is a top view in section of a T-joint attachment header for a snow melting mat according to the present invention.

In addition to the splice attachment 50 discussed above, the snow melting mat 10 includes joint attachments to facilitate angled layout of the snow melting mat 10 with respect to the horizontal plane. As shown in FIG. 6, the exemplary embodiment therein is a T-joint attachment 60, which helps the user to lay down a T-shaped path with several mat sheets 12. The T-joint attachment 60 may be made similar to the sheet 12 and is adapted to be used in conjunction with the splice attachment 50 when laying down the T-shaped path. In other words, three splice attachments 50 would be connected to the T-joint attachment 60 when forming the T-shaped path with one splice attachment 50 on three of the four sides of the square-shaped, T-joint attachment 60, two opposite sides and a top side orthogonal to the other two. To facilitate the necessary fluid flow, the T-joint attachment 60 includes a plurality first angled flow channels 66 on one quadrant, second angled flow channels 68 on the adjacent quadrant, and linear flow channels 64 on the lower half. The flow channels 64 direct flow from a sheet 12 disposed on the left of the T-joint attachment 60 to a mat sheet 12 disposed on the right of the T-joint attachment 60 and vice versa. The first angled flow channels 66 directs flow from a sheet 12 orthogonal to the linear channels 64 to the sheet 12 disposed on the left of the T-joint attachment 60, and vice versa. The second angled flow channels 68 direct flow from the sheet 12 orthogonal to the linear flow channels 64 to a sheet 12 disposed on the right of the T-joint attachment 60, and vice versa. This permits multiple sheets 12 to be laid out where one walkway intersects another at a right angle, while allowing the flow of the circulating heating liquid to be controlled by a single pump 20. It is to be understood that the teachings of the T-joint attachment 60 can be applied to any other shaped joints, e.g., elbow joints, Y-joints, cross joints, and variations thereof.

Thus, it can be seen that the snow melting mat 10 is a safe, economical and highly configurable device for creating a snow and ice free path. The heater-pump 20 does not require much energy usage to heat and pump the liquid medium through the sheet 12 due to the continuous circulation of the antifreeze and the efficient heat transfer characteristics thereof. The various splice attachments and the joint attachments provide the user with the tools to tailor the layout to their individual needs.

It is to be understood that the snow melting device 10 includes a variety of alternatives. For example, the various flow channels, bores, and attachment nozzles may include a variety of shapes other than those shown in the drawings. In a similar vein, the recirculation header 30, the circulation header 40 and the splice attachment 50 are not limited to the rectangular block shapes. They may be any shape, so long as they facilitate fluid flow through one or more sheets 12. The snow melting device 10 may also have some or all the components colored with or without patterns as a visual indicator identifying the components and the specific function thereof, to match with the surroundings, and/or to identify the location of the snow melting mat 10.

It is to be understood that the present invention is not limited to the embodiments described above, but encompasses any and all embodiments within the scope of the following claims.

I claim:

1. A snow melting mat, comprising:

an elongate, flexible sheet defining a flat mat, the sheet having a top surface, a bottom surface, opposed side edges, and opposed ends, the sheet being adapted to be laid on a walkway, the top surface having a plurality of transverse grooves defined therein, the grooves forming a non-slip walking surface, each groove having a depth tapering down towards the side edges of the mat sheet to permit melted snow and ice to run off the top surface;

a plurality of longitudinal fluid flow channels disposed inside the mat sheet, the flow channels extending between opposite ends of the sheet, the flow channels forming a conduit adapted for fluid flow of a heated liquid medium through the sheet;

a hollow recirculation header detachably mounted to one end of the sheet, the recirculation header having a plurality of attachment nozzles selectively coupled to the one end of the sheet for supplying and collecting the liquid medium to and from the fluid flow channels of the sheet;

a hollow circulation header detachably mounted to the opposite end of the sheet opposite the recirculation header, the circulation header having a plurality of attachment nozzles selectively attachable to the opposite end of the sheet, the circulation header directing fluid flow from the fluid flow channels in one side of the sheet to the fluid flow channels in the opposite side of the sheet so that the liquid medium reverses fluid flow direction in the circulation header;

a heater-pump for heating and pumping the liquid medium through the recirculation header, the sheet, and the circulation header, the heater-pump being selectively coupled to the recirculation header;

wherein the heater-pump circulates the liquid medium to maintain the mat sheet at temperatures above freezing for melting snow and ice on the top surface of the sheet to thereby provide a safe walking surface and path and a T-joint attachment to form a T-shaped path with an adjacent pair of the sheets;

wherein the T-joint attachment includes:

a T-joint flexible sheet having a square form and being flat, the T-joint flexible sheet defining a plurality of quadrants;

a plurality of first angled flow channels disposed inside a first one of the quadrants of the T-joint sheet;

a plurality of second angled flow channels disposed inside one of the quadrants adjacent the first quadrant of the T-joint sheet; and a plurality of linear flow channels disposed inside the T-joint sheet below the quadrants;

wherein the first angled flow channels direct inflow of the fluid medium in orthogonal directions, the second angled flow channels direct outflow of the fluid medium in orthogonal directions, and the linear flow channels direct flow of the fluid medium between the adjacent sheets.

2. The snow melting mat according to claim 1, wherein about half of the plurality of longitudinal fluid flow channels is dedicated to fluid flow in one direction, the remainder of the plurality of longitudinal fluid flow channels being dedicated to fluid flow in the opposite direction.

3. The snow melting mat according to claim 1, wherein the hollow recirculation header comprises:

a rectangular block having a plurality of chambers defined therein;

an inflow manifold defined by one of the plurality of chambers, the inflow manifold facilitating fluid flow from the heater-pump to the sheet, the inflow manifold having a first fluid connector for selective connection to the heater-pump and a set of the plurality of attachment nozzles communicating with a select set of the plurality of longitudinal fluid flow channels, the liquid medium flowing between the first fluid connector and the set of the plurality of attachment nozzles; and an outflow manifold defined by another one of the plurality of chambers, the outflow manifold facilitating fluid flow from the sheet to the heater-pump, the outflow manifold having a second fluid connector for selective connection to the heater-pump and another set of the plurality of attachment nozzles communicating with another select set of the plurality of longitudinal fluid flow channels, the liquid medium flowing between the another set of the plurality of attachment nozzles and the second fluid connector.

4. The snow melting mat according to claim 1, wherein the hollow circulation header comprises a hollow rectangular block having a circulation manifold defined therein, the circulation manifold having one set of the plurality of attachment nozzles communicating with one select set of the plurality of longitudinal fluid flow channels and another set of the plurality of attachment nozzles communicating with another select set of the plurality of longitudinal fluid flow channels, the one set of the plurality of attachment nozzles facilitating inflow of the liquid medium into the circulation manifold from the sheet and the another set of the attachment nozzles facilitating outflow of the liquid medium from the circulation manifold back into the sheet.

5. The snow melting mat according to claim 4, wherein the hollow circulation header comprises a lip extending outward from a bottom of the rectangular block.

6. The snow melting mat according to claim 1, wherein the heater-pump comprises:

a hollow housing for storing the liquid medium therein, the housing having outwardly extending connectors, the connectors communicating with the interior of the housing and facilitating selective coupling with the hollow recirculation header;

a pump coupled to the connectors of the housing, the pump facilitating positive inflow and outflow of the liquid medium between the housing and the hollow recirculation header;

a heating unit disposed inside the housing, the heating unit having a heater and connectors coupled to and communicating with the pump;

a power cord adapted for selective connection to a power outlet, the power cord extending from the housing; and a control mounted on the housing, the control setting and monitoring the temperature of the liquid medium and selectively applying power to the pump and the heating unit.

7. The snow melting mat according to claim 1, wherein the attachment nozzles of the recirculation header and the circulation header are tapered.

8. The snow melting mat according to claim 1, further comprising a plurality of LED lights disposed on the top surface of the sheet, the LED lights illuminating the path defined by the sheet.

9. The snow melting mat according to claim 1, further comprising at least one contour strip embedded in the sheet, the at least one contour strip being malleable for shaping the sheet into a user-defined shape conforming to contours of a surface upon which the mat is laid.

10. The snow melting mat according to claim 1, further comprising a splice attachment for coupling adjacent discrete sheets to each other end-to-end.

11. The snow melting mat according to claim 10, wherein the splice attachment comprises a rectangular block having a plurality of spaced attachment nozzles disposed on opposite sides of the rectangular block and a plurality of bores, each of the attachment nozzles on one side being axially aligned with a corresponding one of the attachment nozzles on the opposite side to form a plurality of aligned pairs of nozzles, each of the bores extending between a corresponding one of the aligned pairs of attachment nozzles.

12. The snow melting mat according to claim 1, further comprising the fluid medium, the fluid medium being antifreeze.

* * * * *